US006312296B1

(12) United States Patent
Jones

(10) Patent No.: US 6,312,296 B1
(45) Date of Patent: Nov. 6, 2001

(54) ELECTRICAL CONNECTOR HAVING ENHANCED RETENTION OF CONTACTS IN A HOUSING

(75) Inventor: Dennis B. Jones, Orange, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/595,916

(22) Filed: Jun. 20, 2000

(51) Int. Cl.[7] ..... H01R 13/428
(52) U.S. Cl. ..... 439/751; 439/943; 439/733.1
(58) Field of Search ..... 439/943, 82, 751, 439/733.1

(56) References Cited

U.S. PATENT DOCUMENTS 4,619,495 * 10/1986 Sochor ..... 439/943
5,139,446 * 8/1992 Costello et al. ..... 439/943
5,702,257 * 12/1997 Millhimes ..... 439/943
5,743,769 * 4/1998 Koguchi ..... 439/943
6,109,933 * 8/2000 Lenoir et al. ..... 439/943

* cited by examiner

*Primary Examiner*—Gary Paumen
(74) *Attorney, Agent, or Firm*—Wei Te Chung

(57) ABSTRACT

An electrical connector comprises an insulative housing (20) and a plurality of first and second-type contacts (40, 50) received in the housing. The housing forms a pair of elongate ledges (23) running lengthwise along a bottom face (21) thereof. A plurality of pockets (231) is transversely defined through each ledge. A plurality of first and second passageways (25, 27) is defined through the bottom face of the housing for respectively receiving the first and the second-type contacts. Each second-type contact is of a conventional press-fit design. Each first-type contact includes a compliant pin at a lower end for being attached into a PCB and a mating portion at an upper end for electrically connecting with a mating contact of a mating connector, with a pair of supporting shoulders projecting from the upper end of the compliant pin for being retained in a corresponding pocket of a ledge. This arrangement enhances the support of and the retention force provided to the first-type contacts in the housing during the insertion of the compliant pins of the contacts into the PCB.

1 Claim, 5 Drawing Sheets

ELECTRICAL CONNECTOR HAVING ENHANCED RETENTION OF CONTACTS IN A HOUSING

FIELD OF THE INVENTION

The present invention relates to an electrical connector, and particularly to a connector having contacts which can be firmly retained in a housing to prevent a deflection thereof when the contacts are inserted into a printed circuit board (PCB).

BACKGROUND OF THE INVENTION

SCA-2 connectors are extensively used to interconnect Gigabit Interface Converter (GBIC) modules and backplane systems. Some recently designed SCA-2 connectors have press-fit type contacts for simplifying the mounting of the connectors to related PCBs. The press-fit type contacts are subject to a relatively large resistance force during their insertion into a PCB. This large resistance force can cause the contacts to deflect during insertion if the housing provides insufficient support to contacts. Once the deflection occurs, the contacts may not correctly engage with the conductive plating on the PCB, or even worse, may not be capable of insertion into the PCB to establish an electrical connection.

The value of the present invention lies in an improved structure of a housing of an SCA-2 connector and related press-fit type contacts, which are more effectively retained and supported in the newly-designed housing.

BRIEF SUMMARY OF THE INVENTION

A main object of the present invention is to provide an electrical connector which can reliably retain press-fit contacts in a housing thereof.

Another object of the present invention is to provide an electrical connector having a housing and press-fit contact arrangement which provides increased support to the press-fit contacts mounted therein, thereby assuring the linear travel of the contacts during insertion into a PCB.

An electrical connector according to the present invention comprises an insulative housing and a plurality of first and second-type contacts received in the housing. A pair of elongate stabilizing ledges is formed on a bottom face of the housing, running lengthwise. Each ledge defines a plurality of pockets spaced equidistantly apart from each other in a lengthwise direction of the housing for retaining contacts therein. The arrangements of the pockets of one ledge are staggered with those of the other ledge. A plurality of first and second passageways is defined through the bottom face of the housing for receiving corresponding first or second-type contacts, respectively.

Each first-type contact comprises a mating portion on an upper end for contacting a corresponding contact of a mating connector and a compliant pin on a lower end for being press fit into a PCB. The compliant pin forms a pair of supporting shoulders at its upper end to be firmly lodged in a corresponding pocket of the housing. Each mating portion of each first contact further includes a transverse portion extending horizontally from between the supporting shoulders for connecting the upper end of the mating portion as it sits positioned in a corresponding passageway in the housing with the compliant pin as it sits seated in a pocket of a ledge. Each second-type contact is of a conventional press-fit designed and its fit within the housing is conventional, as well.

Other objects, advantages and novel features of the invention will become more apparent from the following detailed description when taken in conjunction with the accompanying drawings.

DETAILED DESCRIPTION OF INVENTION

Figure 1:
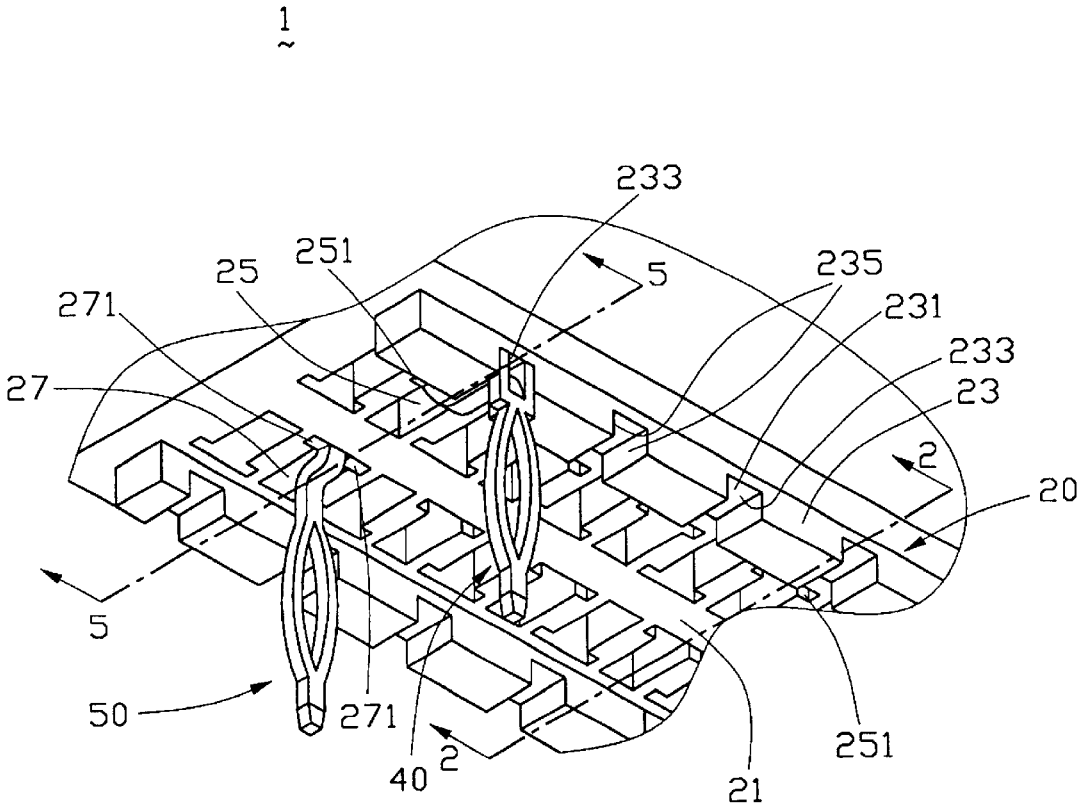
FIG. 1 is a perspective bottom view of a part of an electrical connector in accordance with the present invention, wherein only one first-type and one second-type contact are shown.

Referring to FIG. 1, an electrical connector 1 according to the present invention comprises an elongated insulative housing 20 and a plurality of first-type contacts 40 and second-type contacts 50 (only one of each shown) received in the housing 20.

Figure 3:
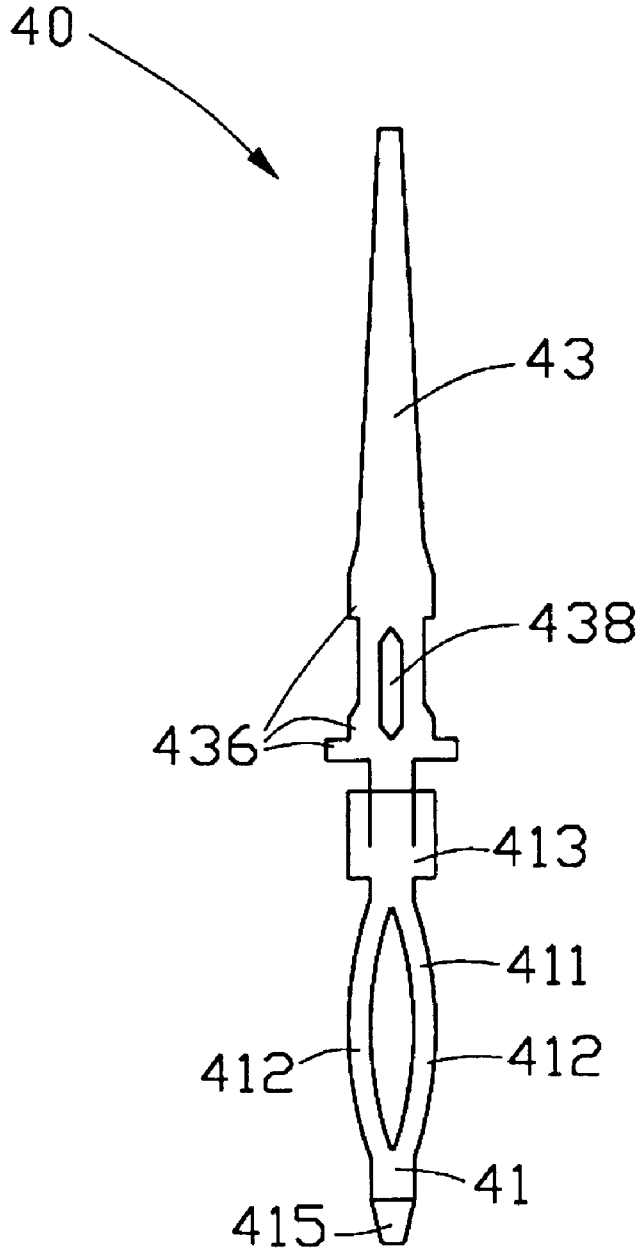
FIG. 3 is a front view of a first-type contact of FIG. 1.

Referring to FIG. 3, each first-type contact 40 comprises a mating portion 43 on an upper end thereof for electrically connecting with a contact of a mating connector (not shown) and a compliant pin 41 on a lower end thereof for insertion into a PCB (not shown). The compliant pin 41 includes a split beam 411 for effectuating a press-fit insertion into the PCB and a guiding tail 415 for facilitating the insertion. The split beam 411 consists of a pair of double supported arcuate beams 412. In theory, the arcuate beams 412 symetrically deform toward each other as the compliant pin 41 is pressed into the PCB. A pair of supporting shoulders 413 extends from an upper end of the compliant pin 41 in a direction opposite the guiding tail 415.

Figure 4:
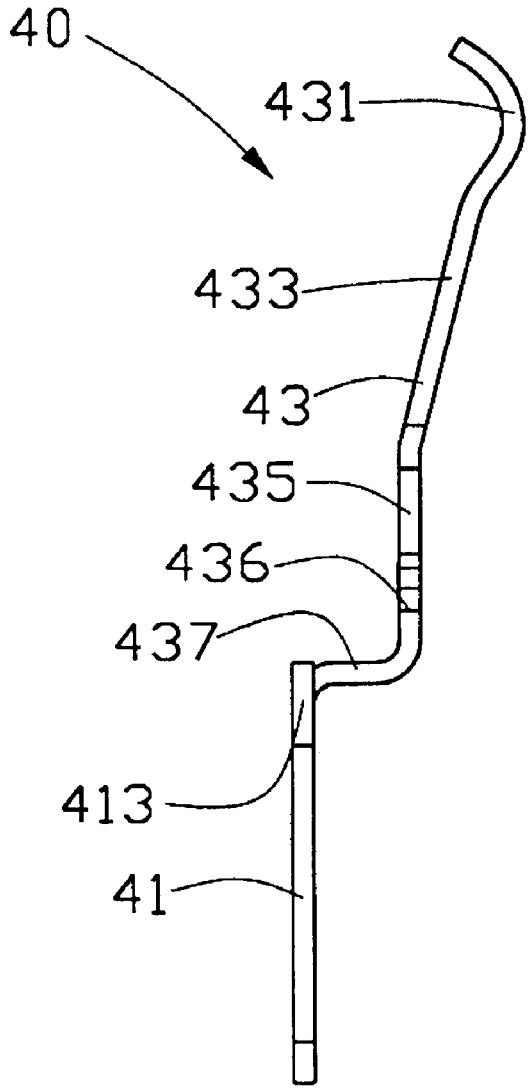
FIG. 4 is a side view of a first-type contact of FIG. 1.

Referring to FIG. 4, the mating portion 43 includes a transverse portion 437 horizontally extending from an upper end of the compliant pin 41 from position between the supporting shoulders 413 and is substantially perpendicular to the compliant pin 41. A retaining beam 435 extends upwardly from and perpendicular to an outer end of the transverse portion 437. The retaining beam 435 forms a plurality of fitting barbs 436 on its opposite sides for having an interferential fit with the housing 20 to secure the contact 40 in the housing 20. Preferably, a void 438 is defined in the retaining beam 435 for enhancing the resiliency thereof, thereby facilitating securing of the contact 40 in the housing 20. A taper plate 433, which has a decreased lateral dimension towards a free end thereof, extends upwardly and inclinedly from an upper end of the retaining beam 435. The taper plate 433 forms a contact portion 431 having an arcuate shape for contacting the contact of the mating connector.

The second-type contact 50 has a conventional design for a press-fit contact; thus, a detailed description thereof is omitted here.

Figure 2:
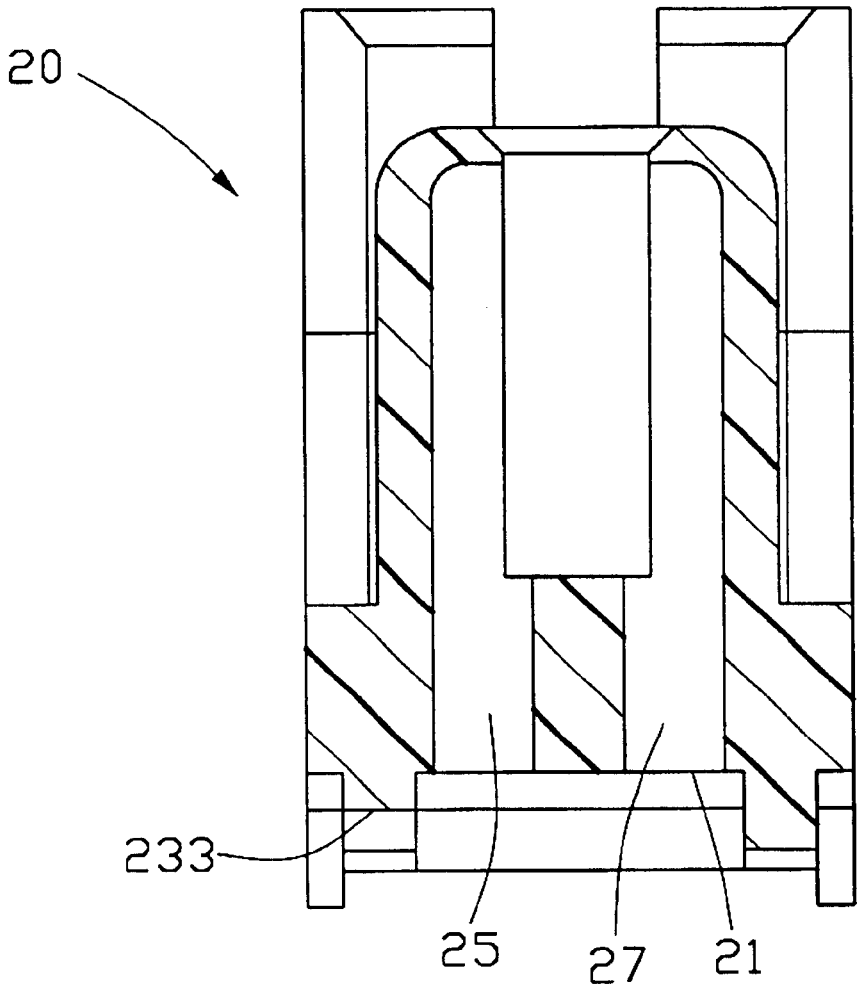
FIG. 2 is a cross-sectional view of a housing of the electrical connector of FIG. 1 taken along a transverse direction thereof.

Referring to FIGS. 1 and 2, the housing 20 forms a pair of elongate stabilizing ledges 23 running lengthwise along opposite sides of a bottom face 21 of the housing 20. A plurality of transverse pockets 231 is cut out at equal intervals along the length of each ledge 23. The placement of the pockets 231 are staggered with those of the other ledge 23. Each pocket 231 has a pocket base 233 at a position lower than the bottom face 21 of the housing 20. Two rows of first passageways 25 are defined through the bottom face 21 of the housing 20. Each first passageway 25 is located adjacent a corresponding pocket 231 to receive the mating terminal 43 of a corresponding first-type contact 40. Each first passageway 25 further defines a pair of cutouts 251 in opposite sides thereof adjacent an edge closest to the pocket 231 for receiving the fitting barbs 436 therein.

Two rows of second passageway 27 are defined through the bottom face 21 of the housing 20. The second passageways 27 alternate with the first passageways 25 in a given row and receive the second-type contacts 50 therein. Each second passageway 27 defines a pair of cutouts 271 in opposite sides thereof adjacent an edge nearest a centerline of the bottom face 21 for receiving fitting barbs (not shown) of a corresponding second-type contact 50.

Figure 5:
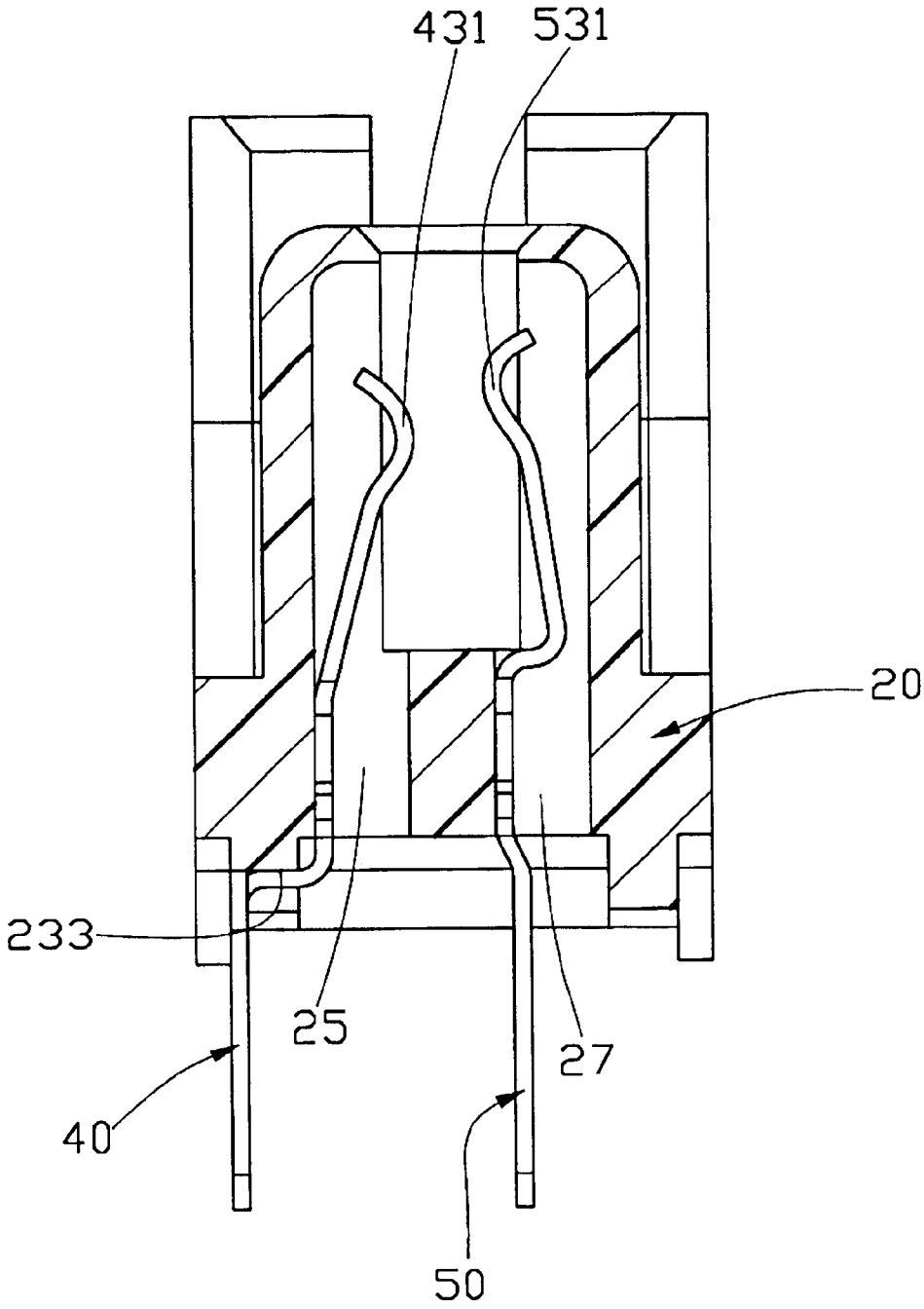
FIG. 5 is a cross-sectional view taken along line 5—5 of FIG. 1.

In assembly, referring to FIGS. 1, 3 and 5, the supporting shoulders 413 of each first-type contact 40 are lodged in a corresponding pocket 231 of a ledge 23, abutting against opposite sides 235 of the pocket 231. The transverse portion 437 of the first-type contact 40 abuts the pocket base 233 of the pocket 231 and transversely extends towards the corresponding first passageway 25 adjacent to the pocket 231, whereby the retaining beam 435 extends into the first passageway 25. The design of the ledge 23 and the first-type contact 40, wherein the supporting shoulders 413 and the transverse portion 437 of the first-type contact 40 snuggly fit within the pocket 231 of the ledge 23, enhances the support of and retention force exerted on the contact 40 in the housing 20. Therefore, the first-type contacts 40 are firmly retained and supported in the housing 20. Thus, a deflection of the first-type contacts 40 from their neutral positions along the lengthwise direction of the housing 20 as the contacts are being press-fit inserted into a PCB (not shown) can be effectively prevented. The taper plate 433 inclines towards a center of the housing 20. The retaining beam 435 abuts an outward side of the first passageway 25. The fitting barbs 436 are respectively held in the opposite cutouts 251 of the first passageway 25.

Each second-type contact 50 is received in a corresponding second passageway 27 by inserting the second-type contact 50 into the corresponding second passageway 27 from the bottom face 21 of the housing 20. Since the mounting of the second-type contacts 50 to the housing 20 is well known in the art, a detailed description thereof is omitted here. Each second-type contact 50 has a contact portion 531 projecting toward the contact portion 431 of a corresponding first-type contact 40. The two contact portions 431, 531 electrically engage with contacts of the mating connector when the mating connector mates with the electrical connector 1 in accordance with the present invention. The contact portion 431 of each contact 40 faces the contact portion 531 of the corresponding contact 50 for contacting and retaining the contacts of the mating connector therebetween.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for connecting a mating connector to a printed circuit board (PCB), comprising:

an elongated insulative housing forming at least a ledge on a bottom face thereof, a plurality of pockets being equidistantly and transversely defined in the ledge; and a plurality of first-type contacts each having an upper end and a lower end and forming a compliant pin on the lower end for being press-fit into the PCB and a mating portion on the upper end for electrically connecting with a corresponding mating contact of the mating connector, the compliant pin having at least a supporting shoulder at its upper end adjacent the mating portion, the supporting shoulder being lodged in a corresponding pocket of the ledge, whereby the first-type contacts are securely retained in the housing and a deflection of the first-type contacts from neutral positions thereof is prevented when the first-type contacts are press-fit into the PCB;

wherein each pocket of the ledges has a pocket base at a position below the bottom face of the housing, and each first-type contact forms a transverse portion extending at an angle from the supporting shoulder and abutting against the pocket base;

wherein a plurality of first passageways is defined through the bottom face of the housing, each aligned with and adjacent to a corresponding pocket of the ledge and receiving the mating portion of a corresponding first-type contact;

wherein each first passageway comprises a pair of cutouts in opposite sides thereof and adjacent an edge thereof which is adjacent to the corresponding pocket, and each first-type contact has a plurality of fitting barbs on opposite sides thereof for having an interferential fit with the cutouts of the corresponding first passageway to secure the first-type contact in the housing;

wherein the housing forms two ledges on the bottom face, said ledges being parallel to one another, pockets being formed in both ledges and the arrangement of the pockets of one ledge being staggered with those of the other ledge;

further comprising a plurality of second-type contacts each having an upper end and a lower end, and forming a compliant pin on the lower end and forming a mating portion on the upper end, and wherein the housing defines a plurality of second passageways in the bottom face thereof, each second passageway to receive a corresponding second contact;

wherein each second passageway defines a pair of cutouts in opposite sides thereof, the location of the cutouts of the second passageway being adjacent an edge of the second passageway closest to the centerline of the bottom face;

wherein the compliant pin of each of the first-type contacts and the second-type contacts forms a split beam, and the split beam consists of a pair of arcuate beams for being press fit into a PCB.

* * * * *